US005090222A

United States Patent [19]

Imran

[11] Patent Number: 5,090,222

[45] Date of Patent: Feb. 25, 1992

[54] ELECTRONIC LOCK BOX AND RETENTION MECHANISM FOR USE THEREIN

[75] Inventor: Mir A. Imran, Palo Alto, Calif.

[73] Assignee: Supra Products, Inc., Salem, Oreg.

[21] Appl. No.: 765,455

[22] Filed: Sep. 25, 1991

Related U.S. Application Data

[63] Continuation of Ser. No. 561,281, Aug. 1, 1990, abandoned, which is a continuation of Ser. No. 274,027, Nov. 21, 1988, abandoned.

[51] Int. Cl.[5] ..... E05B 65/52

[52] U.S. Cl. ..... 70/63; 70/26; 70/39; 70/277; 292/19; 292/86

[58] Field of Search ..... 70/63, 26, 29, 39, 45–47, 70/53, 280, 282, 283, 277, 279, 281; 292/13, 17, 19, 20, 91, 83, 86, 303, 144, 201

[56] References Cited

U.S. PATENT DOCUMENTS

| | | | |
|---|---|---|---|
| 14,030 | 1/1856 | Oldis | 70/46 |
| 470,268 | 3/1892 | Troast | 70/46 |
| 912,910 | 2/1909 | Sohni et al. | 292/201 X |
| 1,139,316 | 5/1915 | Van Valkenburgh | 292/19 |
| 2,507,941 | 5/1950 | Staley | 292/19 |
| 3,063,664 | 11/1962 | Vazzano | 292/86 X |
| 3,753,316 | 8/1973 | Savarieau et al. | 292/19 X |
| 3,780,904 | 12/1973 | Stanford | 292/17 X |
| 4,609,780 | 9/1986 | Clark | 361/172 X |
| 4,851,652 | 7/1989 | Imran | 235/382 |

FOREIGN PATENT DOCUMENTS

| | | | |
|---|---|---|---|
| 1166037 | 3/1964 | Fed. Rep. of Germany | 292/201 |

*Primary Examiner*—Lloyd A. Gall

*Attorney, Agent, or Firm*—Klarquist, Sparkman, Campbell, Leigh & Whinston

[57] ABSTRACT

A retention mechanism having a housing and a member mounted in the housing for movement between the first and second positions. The member has a shoulder formed thereon. A spring yieldably engages opposite sides of the member and the shoulder to prevent movement of the member from the first to the second position. An actuator is provided which includes an element engaging the spring means for moving the spring from a shoulder engaging or latched position to a shoulder disengaging or unlatched position to permit the movement of the member from the first to the second position.

12 Claims, 2 Drawing Sheets

ELECTRONIC LOCK BOX AND RETENTION MECHANISM FOR USE THEREIN

This application is a continuation of application Ser. No. 07/561,281, filed on Aug. 1, 1990, now abandoned, which is a continuation of application Ser. No. 07/274,027, filed on Nov. 21, 1988 now abandoned.

This invention relates to an electronic lock box and more particularly, to an electronic lock box retention mechanism.

In U.S. Pat. No. 4,609,780, there is disclosed an electronic lock box which is provided with latching mechanisms which includes solenoids and L-shaped spring members which are adapted to be engaged by the solenoid plungers to be moved from latched to unlatched positions with respect to a member mounted for movement between first and second positions. The member can be either in the form of a post carried by the key container or in the form of a shackle for the lock box. As explained in copending application Ser. No. 184,204, filed on Apr. 29, 1988, it has been found that such latching mechanisms can possibly be subjected to inadvertent opening by hammer blows applied to the housing. For that reason as disclosed in said co-pending application, safety means has been provided to prevent such inadvertent openings. However, it has been found that such latching mechanisms with such safety means require individual adjustments during assembly thereby requiring additional labor and expense during assembly of the lock box. Thus, there is a need for a new and improved lock box retention mechanism which overcomes such difficulties.

In general, it is an object of the present invention to provide an electronic lock box and retention mechanism for use therein which is reliable.

Another object of the invention is to provide a mechanism of the above character which is not affected by hammer blows to the lock box.

Another object of the invention is to provide a retention mechanism of the above character which does not require individual adjustment.

Another object of the invention is to provide a retention mechanism of the above character which is relatively simple in construction and which can be readily assembled.

Another object of the invention is to provide a retention mechanism of the above character which can be readily operated.

Another object of the invention is to provide a retention mechanism of the above character which can be utilized for shackles and for key containers.

Another object of the invention is to provide a retention mechanism of the above character which requires relatively small amounts of power.

Additional objects and features of the invention will appear from the following description in which the preferred embodiments are set forth in detail in conjunction with the accompanying drawings.

Figure 1:
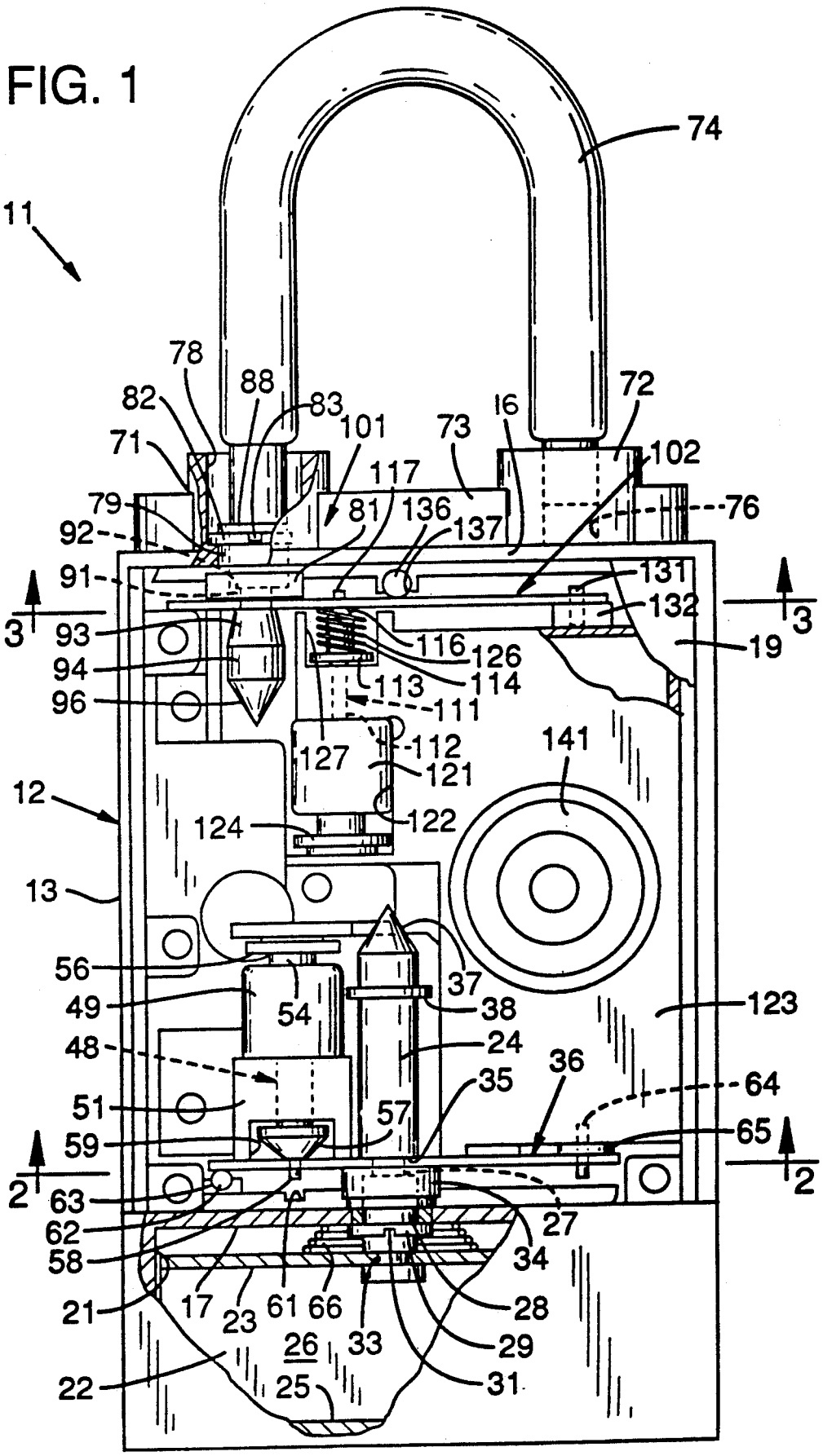
FIG. 1 is a rear elevational view with the rear cover removed and certain portions broken away of an electronic lock box incorporating the retention mechanism of the present invention.

In general, the lock box and retention mechanism includes a housing. A member is mounted in the housing for movement between first and second positions. The member has a recess which provides a shoulder. Spring means yieldably engages opposite sides of the member on one side of the shoulder to permit movement of the member from the first to the second position. Solenoid operated means engages the spring means for moving the spring means out of engagement with the member to permit the member to move from the first to the second position.

More in particular as shown in the drawing, the lock box 11 consists of a housing 12 which is provided with a construction very similar to that disclosed in application Ser. No. 184,204 filed on Apr. 29, 1988 and is provided with spaced apart parallel side walls 13 and 14, a top wall 16 extending at right angles to the side walls 13 and 14 and an intermediate wall 17 which is spaced apart and parallel to the top wall 16. The housing is provided with a front wall 18 and a rear cover plate 19. The housing 12 can be formed of a suitable material such as die cast zinc or aluminum.

A rectangular box-shaped recess 21 is provided in the housing 12 below the intermediate wall 17 and is open through the bottom extremity. The box-shaped recess 21 receives a rectangular key container 22. The key container 22 is provided with a top wall 23 which has an upstanding post 24 mounted therein. It also has a bottom wall 25 and spaced apart parallel side walls 26. The ends of the key container 22 are open to permit ready access to the space therein. A nut 27 formed of a suitable hardened material such as hardened stainless steel is mounted on the intermediate wall 17 and has a bushing 28 formed of hardened brass threaded into the nut 27. The bushing 28 is provided with a flange 29 which seats against the lower surface of the intermediate wall 17. The flange 29 is provided with screwdriver slots 31 to facilitate insertion and removal of the bushing 28.

The upstanding post 24 extends upwardly through the bushing 28. The post 24 forms a part of a latch mechanism 32 for permitting movement of the key container 22 from a key retaining position to a key access position. The post 24 is provided with an annular recess 33 which receives the top wall 23. It also has another annular recess 34 which provides a shoulder 35 which faces towards the key container 22 and which is adapted to be engaged by a spring clip 36 as hereinafter described. The post 24 is provided with a tapered or conical tip 37. A C-ring 38 is mounted on the post 24 near the distal tip 37 and serves as a stop as hereinafter described.

The spring clip 36 is formed of a sheet of material of a suitable type such as 410 stainless steel or beryllium copper which has been hardened to a suitable hardness as, for example, 65 Rockwell. The spring clip 36 is provided with an oval shaped opening 41 into which a mounting tab 42 extends. Aligned slots 43 and 44 are provided between a leaf 46 and a leaf 47 which lie in the same plane on opposite sides of the slots. Each of the leaves 46 and 47 has a free end remote from the opening 41. The slot 43 is relatively narrow in width whereas the slot 44 is wider. The slot 44 opens into the oval shaped opening 41 and also opens into the slot 43. With this construction it can be seen that the leaves 46 and 47 can be spread apart against the yieldable force provided by the portion of the spring clip 36 adjacent the tab 42.

Figure 2:
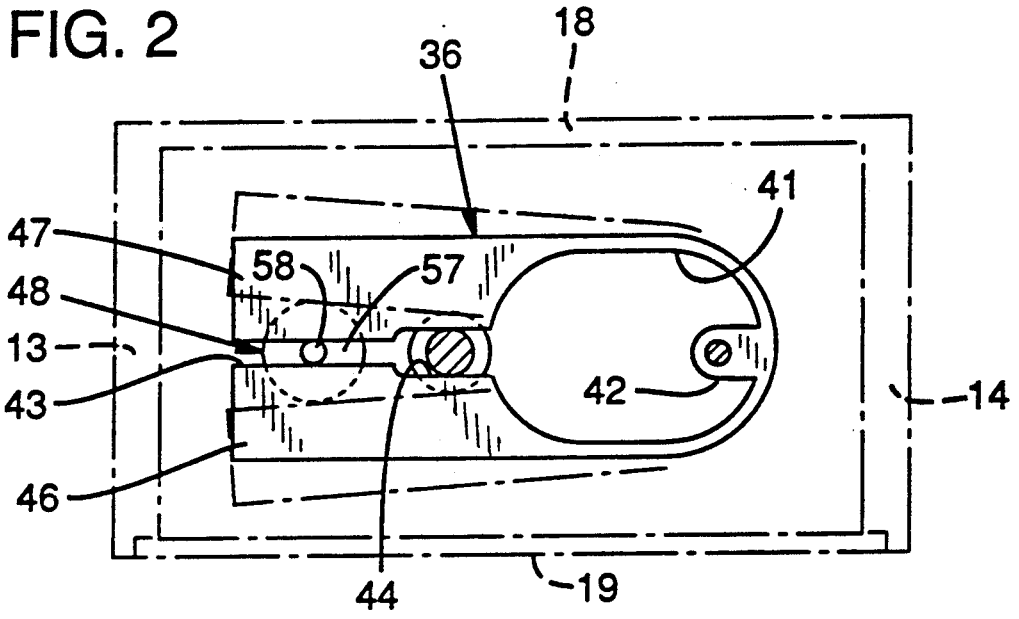
FIG. 2 is a cross sectional view taken along the line 2—2 of FIG. 1.
Figure 3:
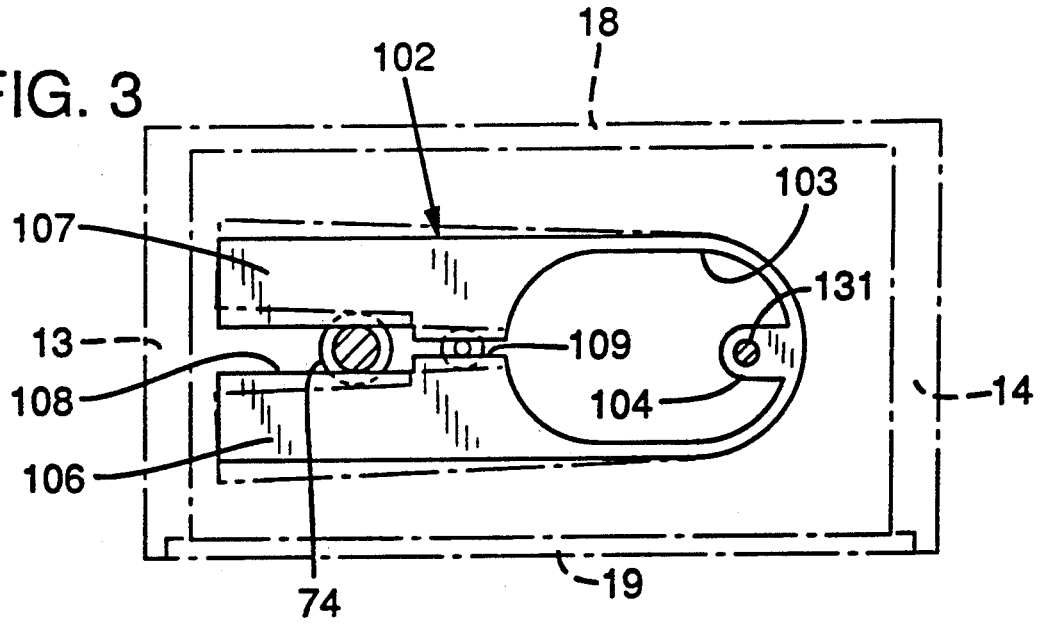
FIG. 3 is a cross sectional view taken along the line 3—3 of FIG. 1.

As shown, particularly in FIG. 2, the post 24 is adapted to extend through the wide slot 44 whereas the plunger 48 of a solenoid 49 is adapted to extend through the slot 43. The plunger 48 extends through a mounting block 51 mounted in the housing 12 and which has the solenoid 49 mounted thereon. The plunger 48 is provided with a cylindrical portion 54 and has a head 56 mounted thereon. A conical member 57 is formed on the distal extremity of the cylindrical portion 54. A cylindrical teat 58 extends below the conical member or portion 57. As can be seen in FIGS. 1 and 2 the teat 58 always extends into the slot 43 between the leaves 46 and 47. The conical member is disposed in a cutout 59 provided in the mounting block 51. A slot 61 is provided in the top surface of the intermediate wall 17 and is adapted to accommodate the tip 58 when the plunger 48 is moved downwardly to operate the spring clip 36. A wear pin 62 formed of a suitable hardened material such as hardened stainless steel is mounted in a horizontally disposed recess 63 which is arcuate in cross-section. As can be seen from FIG. 1, the wear pin 62 is disposed near the distal extremity of the spring clip 36. It supports the distal extremity of the spring clip 36 and resists wear as the leaves 46 and 47 of the spring clip 36 slide over the wear pin 62 when the clip 36 is moved between the latching and unlatching positions with respect to the shoulder 35 of the post 24. The spring clip 36 is mounted in the housing 12 in a suitable manner such as by means of a pin 64 carried by a mounting block 65 provided in the housing.

When the solenoid 49 is energized, the conical portion 57 moves into the slot 43 to press apart and move laterally outwardly the leaves 46 and 47 to the broken line positions shown in FIG. 2 to clear the shoulder 35 provided on the post 24. As soon as the shoulder 35 is cleared by the spring clip 36, the key container 22 is moved outwardly through the opening of the housing 12 under the force of a tapered coil spring 66 disposed on the post 24 between the top wall 23 of the key container 22 and the bottom side of the intermediate wall 17.

The housing 12 is provided with spaced apart upstanding bosses 71 and 72 which are formed integral with the top wall 16. A reinforcing rib 73 extends between the bosses. The lock box 11 is provided with a U-shaped shackle 74 which is removably moved in the lock box. The shackle 74 serves to shackle the lock box to another object. As shown in the drawings, the boss 72 is provided with a cylindrical bore 76 which is adapted to receive one end of the shackle 74. The other boss 71 is provided with a centrally disposed bore 78 extending therethrough. A bushing 79 is formed of a suitable hardened material such as hardened brass and is mounted in the bore 78 and is threaded into a nut 81 also formed of a suitable hardened material such as hardened stainless steel disposed on the lower side of the top wall 16. The bushing 79 is provided with a flange 82 in which screwdriver slots 83 are provided to facilitate insertion and removal of the bushing 79.

The other end of the shackle 74 is adapted to extend into the bore 78 provided in the boss 71 and through the bushing 79. A C-ring 88 is mounted on the shackle 74 and is adapted to engage the bushing 79 to limit the inward travel of the shackle. The shackle 74 is also provided with an annular recess 91 which forms a shoulder 92 which faces away from the top wall 16. The shackle is also provided with a tapered surface 93 which is tapered inwardly toward the annular recess 91. This tapered surface 93 adjoins a cylindrical surface 94. The cylindrical surface 94 adjoins a conical tip 96.

The shackle 74 which has been formed in the manner hereinbefore described forms a part of a shackle latch mechanism 101. The shackle latch mechanism 101 includes a spring clip 102 similar to the spring clip 36. It is formed of a suitable spring material such as 401 stainless steel or beryllium copper. It is formed from a sheet of such material and has one extremity which is rounded as shown and is provided with an oval shaped cutout 103 that has a tab 104 extending therein. Leaves 106 and 107 are provided as a part of the spring clip 102 which are separated by adjoining elongate slots 108 and 109. As can be seen, the slot 108 has a width which is greater than the width of the slot 109. The slot 108 is adapted to accommodate the shackle 74 and is positioned so that the leaves 106 and 1097 can enter the annular recess 91 and engage the shoulder 92 and opposite sides of the shackle 74.

Means is provided for moving the spring clip 102 between latching and unlatching positions and consists of a solenoid operated plunger 111. The plunger 111 is provided with a cylindrical shaft 112. The plunger is also provided with a flange 113 which adjoins the shaft 112. The plunger 111 is also provided with a cylindrical portion 114 which has a diameter substantially greater than that of the shaft 112. The cylindrical portion adjoins a tapered conical portion 116 which adjoins a cylindrical teat 117. The plunger 111 is driven by a solenoid 121 which is mounted in a recess 122 provided in the internal framework 123. The plunger 111 is provided with a head 124 which is movable in the recess 122 and limits the travel of the plunger 111 in a forward direction. Yieldable spring means in the form of a coil spring 126 is provided in another recess 127 provided in the framework 123. The spring is disposed between the spring clip 120 and the flange 113. As can be seen, the teat 117 extends into the slot 109 between the leaves 106 and 107.

The spring clip 102 is mounted in a suitable manner within the housing. For example as is shown, the tab 104 receives a pin 131 which is mounted in a block 132 carried by the internal framework 123.

A cylindrical wear pin 136 is provided for accommodating the sliding movement of the leaves 106 and 107 of the spring clip 102. The wear pin 136 is formed of a suitable hardened material such as hardened stainless steel and is mounted in a horizontally disposed recess 137 which is arcuate in cross section. The wear pin 136 as shown is provided on the side of the spring clip opposite the spring 126.

A speaker 141 is mounted on the block 63 and is used for purposes described in co-pending application Ser. No. 184,204 filed on Apr. 29, 1988.

Operation of the latch mechanisms 32 and 101 for the key container and for the shackle in conjunction with the lock box can now be briefly described as follows. Let it be assumed that the electronic circuitry provided in co-pending application Ser. No. 184,204 filed on Apr. 29, 1988 has been activated to supply power for a suitable period of time, as for example, for 30 to 40 milliseconds to the solenoid 49 to permit access to the key container 22. Energization of the solenoid 49 causes the plunger 48 to be moved in a downward direction as viewed in FIG. 1 to cause the conical portion 57 of the plunger to move into the slot 43 and to separate the leaves 46 and 47 so that the shoulder 32 is cleared. As soon as this occurs, the spring 66 urges the key container in an outward direction until the spring clip 38 engages the spring clip 36 and prevents further outward travel of the key container 22. In this position of the key container, the keys can be readily removed from the key container. When the keys have served the desired purpose, the keys can be reinserted into the key container and the key container pushed to a closed position by pushing the same against the force of the spring 66 until the spring clip 36 again engages the shoulder 35 to lock the key container in a closed or key retaining position. The key container 22 will be retained in this position until the solenoid 49 is again operated.

With the construction shown, it can be seen that the teat 58 which is provided is always disposed between the leaves 46 and 47 of the spring clip so that the plunger is always in the proper position to cause operation of the spring leaves 46 and 47 so they can be moved to the unlatching position and returned to a latched position in the manner hereinbefore described.

The latch mechanism 101 for the shackle operates in a similar manner. Let it be assumed that power is supplied from the electronic circuitry to energize the solenoid 121. When this occurs, the plunger 111 is moved in an upward direction as viewed in FIG. 1 against the force of the spring 126. The spring 126 is a relatively weak spring that permits movement of the plunger so that the tapered portion 116 passes through the slot 109 and so that the cylindrical portion 114 is moved between the leaves 106 and 107 and rests in this position so that the shoulder 92 is cleared. The force of the spring 126 is inadequate to return the plunger 111 to its home position with the leaves 107 and 108 in frictional engagement with the cylindrical portion 114. This makes it possible to energize the solenoid 121 for a relatively short period of time, as for example, 30 to 40 milliseconds without the necessity of removing the shackle prior to deenergization of the solenoid. The shackle 74 can then be removed by holding the lock box in one hand and pulling on the shackle with the other hand. Pulling on the shackle with the other hand causes the tapered surface 93 to come into engagement with the leaves 106 and 107 to move them further apart. Further outward movement of the shackle 74 permits the cylindrical surface 94 to clear the leaves 106 and 107 to permit complete removal of the shackle 74. This permits the lock box 11 to be removed from the doorknob or other fixture to which it is attached.

As soon as this occurs, the frictional engagement between the leaves and the cylindrical portion 114 is minimized to permit the spring 126 to return the plunger 111 to its home position.

When it is desired to reinsert the shackle 74 it can be reinserted by placing one end in the bore 76 and placing the other end in the bore 78. The tip 96 will engage the leaves 106 and 107 to spread the same apart and to permit the tip 96 to pass through the slot 108. Inward movement is continued until the leaves 106 and 107 come into engagement with the recess 91. Thereafter, the shackle 74 will be locked in position by the leaves 106 and 107 engaging opposite sides of the shackle and engaging the shoulder 92 to prevent retraction of the same until another energization of the solenoid 121.

In connection with the foregoing it can be appreciated that in each of the latch mechanisms the spring clips utilized provided leaves which engage opposite sides of the member forming a part of the latch mechanism which in the case of the key container is the post 24 and in the shackle is the shackle 74. Since leaves are disposed on opposite sides, the box when subjected to hammer blows can readily accommodate such hammer blows without any danger of the box opening accidentally. This is because if one of the leaves should move in one direction, the other leaf will have a tendency to move in the other direction and will remain in engagement with the associated shoulder.

Although the foregoing latch mechanisms have been described as having the leaves separated by solenoid operated plungers, other actuators operating elements to separate the leaves can be used. For example, a rotary actuator can be used to rotate a cam or advance a screw to separate the leaves.

The present invention also makes it possible to greatly reduce the battery drain on the battery which is utilized for energizing the solenoids. This is particularly true with respect to the latch mechanism utilized for the shackle. Heretofore it has been necessary to maintain energization of the solenoid 121 until the shackle has been removed. This need has been eliminated by providing the latch mechanism arrangement hereinbefore described in which the solenoid operates the plunger to move the leaf springs into position so that they clear the shoulder of the shackle. The plunger will remain in this position until the shackle is removed. This means that it is only necessary to energize the solenoid momentarily to move the plunger so that the leaves 106 and 107 are separated to clear the shoulder 92. The shackle can thereafter be removed without maintaining energization of the solenoid 121.

What is claimed is:

1. In a retention mechanism, a housing, a member releasably mounted in the housing for movement between a first position and a second position, said member when disposed in said first position having a first portion within the housing, said first portion of the member having a shoulder formed thereon, spring means within the housing having first and second symmetrical leaves having free ends and movable between a shoulder engaging and latched position and a shoulder disengaging and unlatched position, said first and second leaves being adapted to yieldably engage opposite sides of said first portion of the member and said shoulder to assume said shoulder engaging and latched position to prevent movement of said member from the first position to the second position, and actuating means completely contained within the housing, having an axis and being mounted for axial movement and including an element engaging said first and second leaves of the spring means remote from the free ends upon axial movement of the actuating means for moving substantially simultaneously said first and second leaves of said spring means in a direction substantially orthogonal to said axis and from said shoulder engaging and latched position to said shoulder disengaging and unlatched position to permit the movement of said member from the first to the second position, said member when in said second position having a second portion remaining within the housing, said symmetrical leaves of the spring means serving to render said retention mechanism substantially immune to hammer blows to the housing to prevent unauthorized movement of the member from said first position to said second position.

2. A mechanism as in claim 1 wherein said actuating means includes a solenoid operated plunger mounted within the housing.

3. In a lock box, a housing having an opening therein, a key container movable into and out of said opening in said housing between a key retaining position and a key accessible position, a post having an axis mounted on the key container, means providing a shoulder on said post, spring means mounted within the housing having symmetrical portions engaging opposite sides of the post and being in yieldable engagement with the said shoulder and solenoid operated means mounted within the housing having a plunger for movement into engagement with the spring means for moving substantially simultaneously the spring means out of engagement with the shoulder to permit movement of the key container from the key retaining position to the key accessible position, said symmetrical portions of the spring means serving to make the lock box substantially immune to hammer blows to the lock box to prevent inadvertent and unauthorized opening of the key container.

4. A lock box as in claim 3 together with yieldable means mounted in the housing for yieldably urging said key container towards the key accessible position.

5. A lock box as in claim 3 wherein said spring means is in the form of a clip having first and second leaves which are yieldably retained in a shoulder engaging position and wherein said plunger includes means for spreading apart said leaves to move the same from a shoulder engaging position.

6. In a lock box, a housing having an opening therein, a key container movable into and out of said opening in said housing between a key retaining position and a key accessible position, a post having an axis mounted on the key container, means providing a shoulder on said post, spring means mounted within the housing having symmetrical portions engaging opposite sides of the post and being in yieldable engagement with said shoulder, solenoid operated means mounted within the housing having a plunger for movement into engagement with the spring means for moving substantially simultaneously the spring means out of engagement with the shoulder to permit movement of the key container from the key retaining position to the key accessible position, said symmetrical portions of the spring means serving to make the lock box substantially immune to hammer blows to the lock box to prevent inadvertent and unauthorized opening of the key container, said spring means being in the form of a clip having first and second leaves which are yieldably retained in a shoulder engaging position, said plunger including means for spreading part said leaves to move the same from a shoulder engaging position and rod-like means providing a wearing surface of minimal area underlying the leaves to accommodate the movement of the leaves between shoulder engaging and disengaging positions.

7. In a lock box of the sort used to contain keys of houses listed for sale, a housing, shackle means removably mounted in said housing for shackling the lock box to another object, said shackle means when mounted in said housing having a first portion thereof exterior to the housing and a second portion thereof interior of the housing, said portion interior of the housing having a shoulder formed thereon, spring means mounted within the housing and having symmetrical portions thereof engaging opposite sides of the shackle means and engaging said shoulder to prevent removal of the shackle means from the housing, said portions each having a free end, and solenoid operated means within the housing having a plunger for engaging said spring means remote from said free ends and for moving said portions of said spring means substantially simultaneously out of engagement with said shoulder to permit release of the shackle means, said symmetrical portions of said spring means serving as means to make the lock box substantially immune to hammer blows to prevent inadvertent or unauthorized release of the shackle means.

8. A lock box as in claim 7 wherein said plunger has a home position together with yieldable spring means for returning said plunger to the home position.

9. A lock box as in claim 8 wherein said yieldable spring means is of insufficient strength to return the plunger to said home position when the plunger is in engagement with the spring means.

10. A lock box as in claim 7 wherein said shackle means is provided with tapered surfaces adjoining the shoulder so that the shackle means can be removed after the shoulder has been cleared by the portions of the spring means.

11. A lock box as in claim 7 wherein said spring means is in the form of a spring clip having first and second leaves lying in a plane with a slot disposed between the first and second leaves and wherein said plunger extends into the slot at substantially right angles to the plane of the leaves.

12. In a lock box, a housing, a shackle removably mounted in said housing, said shackle having a shoulder formed thereon, spring means mounted within the housing and having portions thereof engaging opposite sides of the shackle and engaging said shoulder to prevent removal of the shackle from the housing and solenoid-operated means having a plunger engaging said spring means for moving said portions of said spring means out of engagement with said shoulder when said solenoid-operated means is energized to permit removal of the shackle, said spring means being in the form of a spring clip having first and second leaves with a slot disposed between the first and second leaves, said plunger moving axially into said slot upon energization of the solenoid-operated means, said plunger having a cylindrical portion which remains disposed in the slot and in engagement with the leaves after the solenoid has been energized.

* * * * *